United States Patent [19]

Beswick

[11] 4,434,548

[45] Mar. 6, 1984

[54] METHOD OF MANUFACTURING PLUG-IN ELECTRICAL FUSES

[75] Inventor: David G. E. Beswick, Warminster, England

[73] Assignee: Kenneth E. Beswick Limited, Frome, England

[21] Appl. No.: 286,815

[22] PCT Filed: Dec. 3, 1980

[86] PCT No.: PCT/GB80/00209

§ 371 Date: Jul. 27, 1981

§ 102(e) Date: Jul. 27, 1981

[87] PCT Pub. No.: WO81/01627

PCT Pub. Date: Jun. 11, 1981

[30] Foreign Application Priority Data

Dec. 3, 1979 [GB] United Kingdom ..... 7941694

[51] Int. Cl.[3] ..... H01H 69/02

[52] U.S. Cl. ..... 29/623; 228/180 R; 228/253; 337/198; 337/295

[58] Field of Search ..... 29/623, 860; 337/159, 337/186, 195, 198, 216, 227, 260, 261, 290, 294, 295, 416; 228/180 R, 253, 254, 259

[56] References Cited

U.S. PATENT DOCUMENTS

| | | | |
|---|---|---|---|
| 2,292,117 | 8/1942 | Grimshaw | 228/259 |
| 2,808,485 | 10/1957 | Cardone | 337/198 |
| 3,421,210 | 1/1969 | Harms et al. | 29/623 |
| 3,775,724 | 11/1973 | Mamrick et al. | 337/245 |
| 4,203,200 | 5/1980 | Wiebe | 29/623 |
| 4,224,592 | 9/1980 | Urani et al. | 29/623 |

*Primary Examiner*—Carl E. Hall
*Assistant Examiner*—P. W. Echols
*Attorney, Agent, or Firm*—Biebel, French & Nauman

[57] ABSTRACT

A plug-in electrical fuse comprises a fusible wire (9) disposed within an insulating housing (1) and connected between the ends of two blade-like terminals (4) secured within and projecting from the housing. Fuses of this type are manufactured by forming a strip of terminal members from strip metal, each member comprising two spaced substantially-coplanar blade-like terminal portions interconnected at their leading ends (5) by an integral cross-bar portion, and each terminal member being integrally connected with each adjacent terminal member in the strip by an interconnecting bar of the metal strip. Fusible wire is secured to the terminal portions adjacent their rear ends to form a strip of terminal and wire assemblies, and this strip of assemblies is mounted in a strip of insulating housings with the fusible wires disposed within the housings and the leading ends of the terminal portions projecting therefrom. The interconnecting and cross-bar portions between adjacent assemblies and between the terminal portions of each assembly are then severed so as to separate the strip into individual fuses. The housings may be retained connected together in strip form and be separated only when the fuses are required for use.

13 Claims, 11 Drawing Figures

METHOD OF MANUFACTURING PLUG-IN ELECTRICAL FUSES

BACKGROUND OF THE INVENTION

The present invention relates to plug-in electrical fuses of the type designed to be plugged directly into socket openings which extend transversely to the length of the fuse body. Such fuses are especially suitable for use in protecting automobile electrical circuits.

A typical plug-in fuse of the above type is described in British Patent Specification No. 1,500,183. This fuse includes a fuse element in the form of a one-piece, plate-like body of fuse metal, the body comprising a pair of laterally spaced generally parallel terminals, each of which comprises a blade portion adapted, in use, to be inserted into a socket, such as a pressure clip terminal, in a mounting panel, and a fusible link portion, of smaller cross-sectional area than the blade terminals, integral with the terminals at positions remote from their leading ends. The fuse element is mounted in an insulating housing so that the fusible link portion is enclosed in the housing and the leading ends of the blade terminals project therefrom for plugging into cooperating sockets. Such fuse elements may readily be mass-produced by stamping them from the end of a strip of fuse metal, preferably, after selected areas have been milled and/or compressed to reduce the cross-sectional areas of the portions of the strip which are to constitute the fusible link portions of the fuse elements.

SUMMARY OF THE INVENTION

An object of the present invention is to provide an improved method of manufacturing plug-in fuses of the type referred to which facilitates mass production of such fuses. The improved method also results in a novel construction of plug-in fuse which is interchangeable with other known fuses of this type.

From one aspect, the present invention is directed to a method of making a plug-in electrical fuse of the type referred to, which method comprises the steps of forming a terminal member from sheet metal material, which member has two spaced, substantially coplanar, blade-like terminal portions interconnected at or adjacent leading ends by an integral cross-bar portion, securing a fusible element to the terminal portions at or adjacent rear ends thereof, mounting the resulting assembly in an insulating housing with the fusible element disposed within the housing and the leading ends of the terminal portions projecting therefrom, and severing the cross bar from the terminal portions.

The terminal member may be formed as a simple stamping from sheet metal material. However, accordingly to a preferred embodiment, it is formed by stamping a generally H-shaped blank from the sheet material, folding the blank about an axis substantially parallel to the cross bar of the H-shape so as to dispose upper and lower portions of the uprights of the "H" in mutually opposed relation to form two blade-like terminal portions of double laminar construction. The laminar forming each of the terminal portions are integrally joined at the leading ends of the terminals, and the terminal portions remain joined together by the cross-bar of the original H-shape until this cross-bar is severed at a later stage in the production of the fuse.

The fusible element, which may comprise a length of fusible wire, may be soldered or welded to the terminal portions adjacent the rear ends thereof. To permit the length of the fusible link provided by the fuse element to be maximized, the terminal portions may be formed, at their rear ends, with mutually opposed rebates, and the fuse element may be connected between the remaining, rearwardly projecting lugs of the terminals. These rearwardly projecting lugs may be engaged in openings extending through the adjacent wall of the insulating housing so as to be accessible through the wall of the housing. Such a construction affords the terminals increased stability and permits testing of a circuit in which the fuse is connected without removal of the fuse.

In the preferred embodiment, where the terminal member is formed from a folded, H-shaped blank so that the blade-like terminal portions have a double laminar construction, the fuse element may be held or clamped between the opposed laminar portions of each terminal, which are folded and flattened with the element disposed therebetween, whereafter the element may be soldered or welded in position. For this purpose, the sheet material from which the terminal blank is formed may be tinned or solder coated and the fusible element may have blobs of solder attached thereto at appropriate positions. Soldering of the fusible element between the laminar portions is then accomplished by the application of heat and pressure. Alternatively, when the fusible element is not provided with solder blobs, the terminal and fusible element assembly may be dip soldered to secure the wire in position.

For higher current ratings, which would require a fuse wire of relatively large diameter, it may be desirable to use a rolled, flattened fusible wire, thereby to reduce the bulk of the fuse wire disposed between the laminar portions of the terminals and permit the laminar portions to be satisfactorily flattened together into abutting relation. Alternatively, to permit the laminar portions to be completely flattened together with a fusible element therebetween, one or both of the laminar portions may be formed with an inwardly facing transverse groove at the position where the fusible element is to be secured. By solder dipping, the groove may be filled with solder before positioning of the fusible element, which would not require solder blobs at its fixing positions. The application of heat and pressure closes the laminar portions together and secures the element in the groove(s). This method of securing the fusible element may also be used where the terminal member comprises a single lamination and is formed as a simple stamping from sheet material. In this case, transverse grooves are formed respectively in corresponding faces of the blade-like terminal portions, at the positions where the fusible element is to be fixed, and these grooves are filled with solder by dip soldering and the fusible element is secured in the grooves by the application of heat and pressure.

The insulating housing may have a slot-like cavity extending thereinto from one edge of the housing for receiving the rear ends of the blade terminals and the fusible element. The terminal and element assembly may be secured in the housing by means of dimples or detents formed in the terminal portions which snap into engagement with cooperating detents or dimples formed in the cavity walls when the assembly is inserted into the housing cavity. In one embodiment, the transverse grooves formed in the terminal portion for the purposes of locating and fixing the fusible element may form transverse ribs on the outsides of the terminals which serve as detents and snap into cooperating dimples in the cavity walls to secure the terminals in position.

The present invention is particularly adapted to enable the manufacture of plug-in fuses by mass production techniques. Hence, from another aspect, the invention is directed to a method of mass-producing plug-in electrical fuses of the type referred to, which method comprises the steps of forming a strip of terminal members from sheet metal material, each member having two spaced, substantially coplanar, blade-like terminal portions interconnected at or adjacent leading ends by an integral cross-bar portion, and each member being integrally connected with the or each adjacent terminal member in the strip by an interconnecting bar of the sheet material, securing a fusible element or elements to the terminal portions at or adjacent rear ends thereof to form a strip of terminal and element assemblies, mounting the assemblies in insulating housings with the fusible elements disposed within the housings and the leading ends of the terminal portions projecting therefrom, and severing the interconnecting and cross-bar portions of sheet material from between adjacent assemblies and from between the terminal portions of each assembly so as to separate the strip into individual fuses.

The strip of terminal members may be a simple stamping from strip metal material or in accordance with the preferred embodiment may be stamped as a strip of H-shaped terminal blanks, each of which is integral with the or each adjacent blank in the strip via an interconnecting bar of the sheet material extending substantially parallel to the cross-bars of the H-shaped blanks. In the latter event, the strip of H-shaped blanks is folded about an axis substantially parallel to the cross-bars of the H-shapes so as to dispose upper and lower laminar portions of the uprights of each H-shape in mutually opposed relation for forming the two blade-like terminal portions of double laminar construction for each fuse.

Conveniently, adjacent terminal blanks in the strip are spaced from one another, by the interconnecting bars, by the same distance as the spacing between the terminal portions of each blank, and these interconnecting bars are disposed coaxially with the cross-bar portions of the terminal blanks. The fusible element may be formed from a fuse wire which is of sufficient length to be secured to the terminal portions of all the blanks in the strip. If this fuse wire is welded or soldered with the aid of blobs of solder previously attached to the wire, in the manner described above, the solder blobs are attached to the wire at intervals corresponding to the spacing between adjacent terminal portions.

From a further aspect, the present invention is directed to a novel construction of plug-in electrical fuse of the type comprising an insulating housing, a pair of substantially coplanar, blade-like terminals projecting from the housing substantially parallel to one another, and a fusible element secured between the blade terminals within the housing.

In the preferred embodiment, each blade-like terminal comprises two laminar portions disposed in mutually opposed abutting relation and integrally joined at the projecting or leading end of the terminal.

BRIEF DESCRIPTION OF THE DRAWINGS

In order that the present invention may be more readily understood, reference will now be made to the accompanying drawings, in which.

DESCRIPTION OF THE PREFERRED EMBODIMENT

Figure 1:
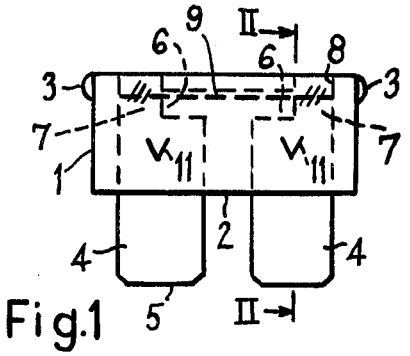
FIG. 1 is a side elevation of a plug-in electrical fuse constructed in accordance with the invention.
Figure 2:
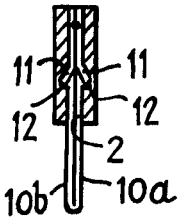
FIG. 2 is a section on the line II—II of FIG. 1.

Referring to FIGS. 1 and 2, the plug-in electrical fuse comprises a generally rectangular housing 1 made from insulating material, such as a plastics material, and having a slot-like cavity 2 extending into the housing from the bottom edge thereof. The housing has small shoulders 3 moulded at opposite ends thereof for facilitating plugging-in and removal of the fuse. A pair of substantially coplanar, blade-like terminals 4 are mounted within the slot-like cavity 2 of the housing in substantially parallel relation and have leading ends 5 projecting from the housing. The rear ends of the terminals are formed with mutually opposed rebates 6 and the remaining, rearwardly-projecting lugs 7 are engaged in openings 8 extending through the adjacent, top wall of the housing 1 so that electrical contact can be made with the terminals, if desired, for example, for the purposes of circuit testing without necessitating removal of the fuse. Each terminal 4 is composed of two laminar portions 10*a*, 10*b* disposed in mutually opposed, abutting relation and integrally joined together at the leading end 5 of the terminal, about which these laminar portions are folded to produce the terminal, as will hereinafter be more fully described. During the manufacturing process, the laminar portions 10*a*,10*b* of each terminal are flattened together and a fusible wire 9, which extends between the lugs 7 adjacent the rear wall of the slot 2 is secured to each terminal by being clamped and soldered between the flattened laminar portions 10*a*,10*b*. The terminals are retained in position in the housing by detents 11 on the outside surfaces of the laminar portions 10*a*,10*b* which snap into engagement with cooperating dimples 12 on the opposing inside surfaces of the slot-like cavity 2.

Figure 3:
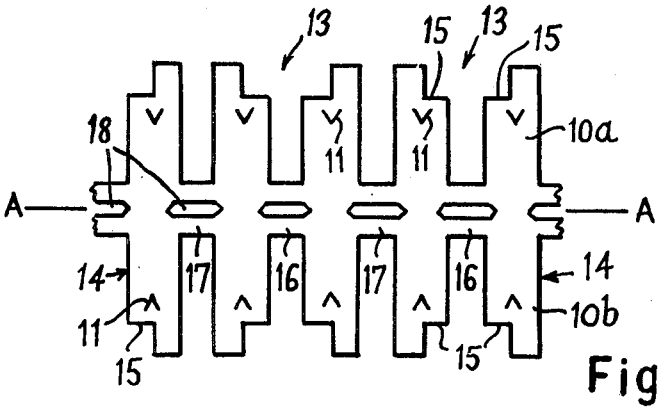
FIG. 3 is a plan view of a strip of terminal blanks used in the manufacture of plug-in fuses the type illustrated in FIGS. 1 and 2, FIGS. 4, 5 and 6 illustrate steps in the method of manufacturing such fuses.

Fuses of the construction described with reference to FIGS. 1 and 2 may be mass-produced as follows. Referring to FIG. 3, a continuous strip of terminal blanks 13 is stamped from sheet metal strip. Each blank 13 is of generally H-shape in plan and comprises upright laminar portions 14, which have mutually opposed rebates 15 at opposite ends, and a central cross-bar 16. Adjacent blanks in the strip are joined together by interconnecting bars 17 of the strip material which are coaxial with and identical of the cross-bars 16. To facilitate folding of the strip about the central longitudinal axis A—A of the bars 16,17, elongated openings 18 are formed centrally of the bars during the stamping process. Also, during the stamping process, the small detents 11, such as tags, are formed in the upper and lower portions 10*a*,10*b* of the uprights 14 so as to project from one side of the strip.

Figure 4:
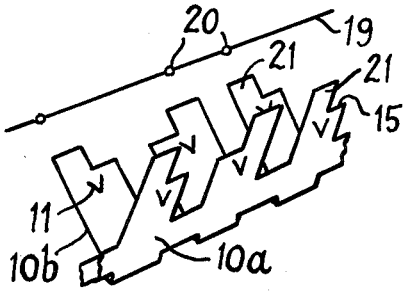
Figure 5:
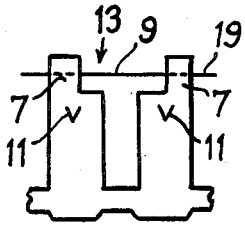
Figure 6:
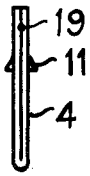

Following stamping, the strip of terminal blanks 13 is folded longitudinally about the axis A—A so as to dispose the upper and lower laminar portions 10*a*,10*b* of the uprights 14 in mutually opposed relation for forming the blade-like terminals 4 of the fuses. The detents 11 are disposed on the outsides of the folded strips. As shown in FIG. 4, the strip is initially folded only to a partially closed position, whereupon a continuous length of fusible wire 19 having blobs 20 of solder attached thereto at intervals corresponding to the spacing between adjacent terminals is located between the partially folded laminar portions 10*a*,10*b* adjacent their ends remote from the fold, that is, between the projecting lug portions 21 formed by the rebates 15 and which constitute the lugs 7 in the finished fuses. The opposing laminar portions 10*a*, 10*b* are then flattened together into abutting relationship, as shown in FIGS. 5 and 6, in order to produce terminal members having blade-like terminals 4 and clamp and hold the fuse wire 19, and the wire is soldered in position by the application of heat and pressure. The terminal blanks 13 are tinned or solder coated prior to the folding process in order to permit this soldering operation.

Having severed the continuous fuse wire 19 at locations between adjacent terminal members or pairs of terminals so as to leave the pairs of terminals electrically connected by the fuse wire links 9, the resulting strip of terminal and fuse wire assemblies are attached to insulating housings 1. The latter are moulded in "chocolate block" form and are fitted to the terminal and fuse wire assemblies as a strip of housings interconnected by thin webs of the plastics insulating material. These webs space the housings at intervals corresponding to the spacing between the terminal and wire assemblies of the terminal strip. The rear ends (see FIGS. 1 and 2) of the pair of terminals 4 of each assembly are inserted into the slot-like cavity 2 of an associated housing and the lugs 7 engage in the openings 8 in the rear wall of the housing whilst the detents 11 on the outside faces of the terminals snap into engagement with the cooperating dimples 12 moulded on the inside surfaces of the slot-like cavity so as to mount and retain the terminals, together with the associated fuse wire link 9, in the housing. After assembling the terminals to the housings, the interconnecting bars 17 of strip material (see FIG. 5) between adjacent assemblies, and the cross-bars 16 between the terminals of each assembly are cropped out in order to separate the terminal strip into individual fuses. However, the fuses may be retained connected together in strip form by the plastics webs interconnecting the housings and these may be broken to separate the fuses only when they are required for use.

Figure 7:
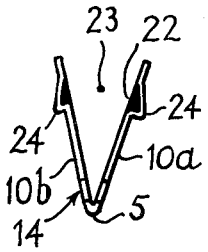
FIGS. 7, 8 and 9 illustrate the method of manufacturing another embodiment of the invention.
Figure 8:
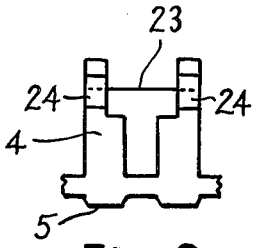
Figure 9:
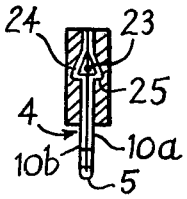

FIGS. 7, 8 and 9 illustrate a modified method of fixing the fusible wire, whereby the wire fixing arrangement also serves as detents for securing the terminals within the insulating housing. Hence, the projecting lugs 21 at opposite ends of the uprights 14 are formed with transverse grooves 22 which, when the upper and lower laminar portions 10*a*,10*b* of the uprights are folded into opposing relation, are themselves disposed in opposing relation on the insides of the portions and in alignment with the grooves in the associated laminar portions. Prior to folding, the grooves are filled with solder by a solder dipping process and, after the strip is folded to its partially closed position shown in FIG. 7, a continuous fusible wire 23, without solder blobs, is located between the partially folded portions in register with the grooves, and then the laminar portions 10*a*,10*b* are flattened together with the application of pressure and heat so that the wire is soldered in position within the grooves 22 and the laminar portions are fully flattened together (FIGS. 8 and 9). The grooves 22 form ribs 24 on the outsides of the laminar portions and are so shaped that these ribs are generally barb-like in cross section, with the barbs facing towards the formed, leading ends 5 of the laminar portions. These barb-like ribs 24 serve as detects to secure the terminals within the slot-like cavity 2 in the housing 1 and, when a terminal assembly is inserted into the slot-like cavity in its associated housing, the ribs 24 snap into cooperating grooves 25 in the inside surfaces of the cavity when the assembly is fully inserted (FIG. 9).

Figure 10:
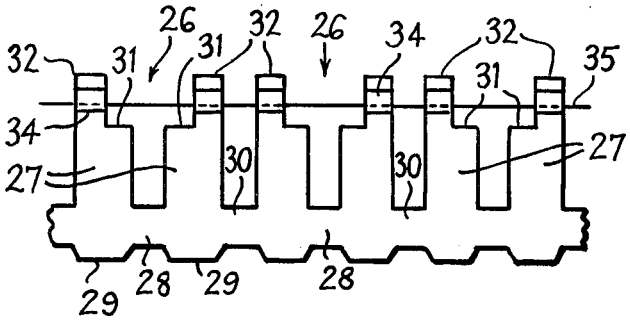
FIGS. 10 and 11 illustrate the method of manufacturing a further embodiment.
Figure 11:
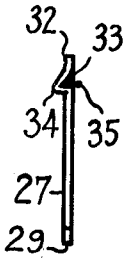

FIGS. 10 and 11 illustrate the manufacturing of plug-in electrical fuses in which the blade-like terminals consist of a single thickness of sheet metal. A continuous strip of terminal members 26 is blanked or stamped from sheet metal strip. Each member or blank 26 comprises two spaced, blade-like terminal portions 27 interconnected by an integral cross-bar portion 28 adjacent the leading ends 29 of the terminals. Adjacent members in the strip are joined together by interconnecting bars 30 of the strip material which are coaxial with and identical to the cross-bar portions 28. At their rear ends, each pair of terminal portions 27 is formed with mutually opposed rebates 31 so as to leave rearwardly projecting lugs 32. During the stamping process, these lugs are formed in corresponding faces with aligned grooves 33 which define a projecting rib 34 on the opposite face of barb-like configuration. The lugs 32 are solder-dipped to fill the grooves 33 with solder and, thereafter, a continuous length of fusible wire 35 is located along the grooves and is soldered in position in the grooves by the application of pressure and heat. The wire 35 is then severed, the strip of terminal and fuse wire assemblies is mounted in a strip of insulating housings (not shown) similar to those of the previous embodiments and the interconnecting bars 30 of strip material between adjacent assemblies and the cross-bar portions 28 between the terminal portions 27 of each assembly are severed in order to separate the strip into individual fuses. The terminals are retained in the insulating housings by the ribs 34 which snap into engagement with cooperating grooves moulded on the inside surfaces of the slot-like cavities in the housings.

Whilst particular embodiments have been described, it will be understood that various modifications can be made without departing from the scope of the invention. For example, where a short fusible link is acceptable, rebates 6 need not be formed at the rear ends of the blade-like terminals in the region where the fusible wire is to be secured and the wire may simply be secured between the main bodies of the terminals.

I claim:

1. A method of manufacturing a plug-in electrical fuse of the type in which the fusible element is disposed within an insulating housing and is electrically connected between the adjacent ends of two spaced substantially-coplanar blade-like terminals secured within and projecting from the housing comprising the steps of:

forming a generally H-shaped terminal blank from sheet metal material, said blank having laminar uprights integrally joined by a laminar cross-bar portion, folding said H-shaped blank about an axis substantially parallel to said cross-bar portion of said blank to dispose upper and lower laminar portions of said uprights of said H-shaped blank in generally mutually opposed relationship, locating a fusible element so that it is disposed between the opposed laminar portions of said blank, flattening said opposed laminar portions together with said fusible element disposed therebetween to form an assembly including blade-like terminal portions of double laminar construction having said fusible element electrically connected therebetween, mounting said assembly in an insulating housing with said fusible element disposed within said housing and the leading ends of said blade-like terminal portions projecting therefrom, and severing said cross-bar portion from between said terminal portions.

2. The method claimed in claim 1, in which said sheet material, from which said terminal blank is formed, is tinned and said fusible element has blobs of solder attached thereto at positions corresponding to said terminal portions, and in which said fusible element is soldered in position between said opposed laminar portions of the folded blank by applying heat and pressure thereto.

3. The method claimed in claim 1, in which the terminal and element assembly is dip-soldered to secured said fusible element in position.

4. A method of manufacturing plug-in electrical fuses of the type in which a fusible element is disposed within an insulating housing and is electrically connected between the adjacent ends of two spaced substantially-coplanar blade-like terminals secured within and projecting from said housing, comprising the steps of:

forming a strip of generally H-shaped terminal blanks from sheet metal material, each said blank having laminar uprights integrally joined by a laminar cross-bar portion and each said blank being integrally joined with an adjacent blank in said strip by an interconnecting bar portion of said sheet material extending substantially parallel to said cross-bar portions of said H-shaped blanks, folding said strip of H-shaped blanks about an axis substantially parallel to said cross-bar portions of said blanks to dispose upper and lower laminar portions of said uprights of each said H-shaped blank in generally mutually opposed relationship, locating fuse element means so as to be disposed between the opposed laminar portions of said blanks, flattening said opposed laminar portions together with said fuse element means disposed therebetween and forming a strip of terminal and element assemblies, each of which includes two blade-like terminal portions of double laminar construction having a fusible element electrically connected therebetween.

mounting said assemblies in insulating housings with said fusible elements disposed within said housings and the said leading ends of said terminal portions projecting therefrom, and severing said interconnecting and cross-bar portions from between adjacent assemblies and from between said two terminal portions of each assembly for separating said strip into individual fuses.

5. The method claim in claim 4, in which said sheet material, from which said strip of terminal blanks is formed, is tinned and said fuse element means has blobs of solder attached thereto at positions corresponding to said terminal portions, and in which said fuse element means is soldered in position between said opposed laminar portions of the folded blanks by applying heat and pressure thereto.

6. The method claimed in claim 4, in which said terminal and element assemblies are dip-soldered to secure said fuse element means in position.

7. The method claimed in claim 4, in which said fusible element means is soldered to said terminal portions adjacent the rear ends thereof.

8. The method claimed in claim 4, in which adjacent said terminal blanks in said strip are spaced from one another, by said interconnecting bar portions, by substantially the same distance as the spacing between said uprights of each of said blanks, and said interconnecting bars are disposed coaxially with respect to said cross-bar portions of said terminal blanks.

9. The method claimed in claim 4, including the step of forming at least one of each pair of said opposed laminar portions with an inwardly facing transverse groove at the position where said fuse element means is to be secured.

10. The method claimed in claim 4, in which each of said insulating housings has a slot-like cavity extending thereinto from one edge of said housing for receiving the rear ends of the associated terminal and element assembly, and in which each terminal and element assembly is secured in the associated housing by means of cooperating dimples and detents formed in said terminal portions and the cavity wall, said dimples and detents snapping into engagement when said assembly is inserted into the housing cavity.

11. The method claimed in claim 10, in which at least one of each pair of said opposed laminar portions is formed with an inwardly facing transverse groove at the position where said fuse element means is to be secured and in which said transverse grooves form transverse ribs on the outsides of said terminal portions of each said assembly which serve as said detents and snap into cooperating dimples in said cavity wall to secure said assembly in position in said associated housing.

12. The method claimed in claim 4, in which said terminal portions of each folded blank have mutually opposed rebates at their rear ends, and said fuse element means is connected between the rearwardly projecting lugs defined by said rebates.

13. The method claimed in claim 12, in which said rearwardly projecting lugs are engaged in openings extending through an adjacent wall of the associated insulating housing so as to be accessible through said wall of said housing.

* * * * *